United States Patent [19]

Kunishige

[11] Patent Number: 4,472,208

[45] Date of Patent: Sep. 18, 1984

[54] HOT-ROLLED HIGH TENSILE TITANIUM STEEL PLATES AND PRODUCTION THEREOF

[75] Inventor: Kazutoshi Kunishige, Kawanishi, Japan

[73] Assignee: Sumitomo Metal Industries, Ltd., Osaka, Japan

[21] Appl. No.: 507,009

[22] Filed: Jun. 23, 1983

[30] Foreign Application Priority Data

Jun. 28, 1982 [JP] Japan ..... 57-111351
Feb. 17, 1983 [JP] Japan ..... 58-23747
Feb. 17, 1983 [JP] Japan ..... 58-23748

[51] Int. Cl.[3] ..... C21D 8/02

[52] U.S. Cl. ..... 148/12 F; 148/12.4; 148/36

[58] Field of Search ..... 75/124 B, 123 M, 126 D; 148/12.3, 12.4, 12 F, 36

[56] References Cited

U.S. PATENT DOCUMENTS 4,082,576 4/1978 Lake et al. ..... 148/12.3
4,388,122 6/1983 Sudo et al. ..... 148/12.4

FOREIGN PATENT DOCUMENTS 134019 10/1979 Japan ..... 148/12 F
34659 3/1980 Japan ..... 148/12 F
115923 9/1980 Japan ..... 148/12.4
152128 11/1980 Japan ..... 148/12.4

*Primary Examiner*—Peter K. Skiff
*Attorney, Agent, or Firm*—Burns, Doane, Swecker & Mathis

[57] ABSTRACT

A hot-rolled high tensile titanium steel plate and production thereof are disclosed. The steel plate has improved toughness and cold formability and is made of a killed steel which consists essentially of:

| | |
|---|---|
| C: 0.05–0.20 wt %, | Si: not more than 1.2 wt %, |
| Mn: 0.5–2.0 wt %, | Ti: 0.04–0.20 wt %, |
| P: not more than 0.025 wt %, | S: not more than 0.015 wt %, |
| sol. Al: 0.005–0.15 wt %, | O: not more than 0.0080 wt %, |
| N: not more than 0.0080 wt %, | B: 0–0.0030 wt %, |
| Cr: 0–1.0 wt %, | |
| Ca: 0–0.010 wt %, | |

the balance being Fe and incidental impurities, the Ti content comprising not less than 0.02 wt % of incoherently precipitated Ti and not more than 0.015 wt % of coherently precipitated Ti, and said killed steel containing 20 to 90% by volume of a bainitic structure and not less than 10% by volume of a ferritic structure.

20 Claims, 6 Drawing Figures

COILED AT 600°C (COMPARATIVE)

COILED AT 400°C (INVENTION)

HOT-ROLLED HIGH TENSILE TITANIUM STEEL PLATES AND PRODUCTION THEREOF

BACKGROUND OF THE INVENTION

The present invention relates to a hot-rolled titanium steel plate having a tensile strength of 70 kg/mm$^2$ or more, as well as improved formability and toughness at low temperatures.

The demand for steels having high strength and formability that can be used as structural materials in buildings and industrial machines and facilities has increased these days. To meet this demand, various types of steel have been developed and come to be used commercially. Among them are niobium steels, vanadium steels and titanium steels. Especially, titanium steel, i.e., Ti-containing steel is attractive because of its low manufacturing cost and high tensile strength. However, the toughness, particularly low temperature toughness of titanium steel is markedly degraded in comparison with that of niobium steels and vanadium steels.

On the other hand, because of the necessity of developing new energy resources, the exploitation of gas and oils, for example, is being extensively carried out even under severe environmental conditions. Therefore, there is a demand for structural materials which can be used under such severe conditions. For example, in the case of a high tensile steel plate 4.5 mm or larger in thickness being used in a cold environment, brittle fracture at the portion where plastic deformation has been applied sometimes results. From this viewpoint, too, it is highly desirable to provide a high tensile steel plate which exhibits improved low temperature toughness, making the steel plate feasible to use under severe conditions in a cold environment in addition to improving properties including high tensile strength and formability.

Hot-rolled, high tensile titanium steel plates are characterized by using the precipitation hardening of TiC and forming TiS (C-type inclusion, i.e. globular inclusion) instead of MnS (which is an A-type inclusion, i.e. elongated inclusion) so as to improve the cold formability of the plates. There are disclosed some papers which treat hardening of steel plates caused by the addition of titanium thereto: "Alloying possibilities for increasing strength and toughness of weldable structural steels" by L. Meyer et al and "The role of strong carbide and sulfide forming elements in the manufacture of formable high strength low alloy steels" by M. Korchynsky et al, SYMPOSIUM, LOW ALLOY HIGH STRENGTH STEELS, Nuremberg, May 21–23, 1970, pp. 9–15 and pp. 17–27, respectively, for example.

A method depending upon this technique is disclosed, for example, in Japanese Patent Publication (JPP) No. 45614/80 and No. 47256/82 and Japanese Patent Laid-Open Specification (JPLOS) No. 84422/81 and No. 41325/81.

In accordance with the disclosures made in JPP No. 47256/82 and No. 45614/80, in addition to using the precipitaion hardening of TiC, Ti itself is used effectively by decreasing the contents of sulfur, nitrogen and oxygen. In order to ensure good cold formability, a fine ferrite structure is produced, and for the purpose of preventing the formation of a bainitic structure, the hot-rolled steel is coiled at a controlled temperature in the range of 500° to 680° C. JPLOS No. 41325/81 also discloses coiling at a temperature of 550°–650° C. JPLOS No. 84422/81 discloses the production of titanium-containing steel plates having a ferrite+pearlite structure, which are subjected, after hot rolling, to cold rolling followed by annealing to provide a steel plate with a sufficient degree of tensile strength.

The so produced Ti-containing steel plate in the prior art has not only improved strength but also a very high cold formability as demonstrated by the fact that a sample with its edges finished by machining can withstand a "close" contact bending test according to the JIS (Japanese Industry Standards).

In the bending test according to the JIS, all samples have their edges finished by machining. However, in almost all cases of commercial production of structural members, blanks shorn to a predetermined size are immediately subjected to cold working without trimming the shorn edges. Therefore, from an application point of view, the cold formability of commercial steel plates must be evaluated by the bending performance of samples with as-shorn edges. However, recent studies on commercial production of Ti-containing hot-rolled steel plates have revealed that most of them including the plates produced by the methods described in JPP No. 45614/80 and JPP No. 47256/82 perform very poorly in a bending test with blanks having as-shorn edges and that they develop cracks in the edges during bending.

Taking these facts into account, the present inventor made various studies to improve the formability of blanks of titanium steel plates with untrimmed, as-shorn edges, as well as the low temperature toughness which is typically low with titanium steel plates. As a result, the inventor has found that a Ti-containing steel plate having improved formability and low temperature toughness can be produced from a steel having a specific chemical composition by controlling its microscopic structure. The present invention has been accomplished on the basis of this finding.

The observations obtained during the studies leading to the accomplishment of the present invention are as follows:

Titanium steel plates that have been coiled at the ordinary coiling temperature (ca. 600° C.) after hot rolling can withstand a close contact bending test under the JIS, so it must be concluded that they have good formability. However, if blanks with as-shorn edges are subjected to the same test, it is difficult to avoid bending cracks due to the cracks already present in the as-shorn edges as induced by the brittleness of the ferrite grain boundary peculiar to hot-rolled titanium steel plate. The reason for the great possibility of cracks to develop in the ferrite grain boundary of shorn edges is that hot-rolled titanium steel plates produced by the conventional process depends on the precipitation hardening of TiC that primarily forms after the hot rolling for their high strength. Most of the TiC that is finely precipitated after the rolling occurs within the ferrite grains, and less is found along the grain boundary. Furthermore, coiling the hot-rolled steel plate at high temperature causes cementite to be precipitated along the grain boundary. As a result, the strength of the grain boundary is decreased relative to the matrix in the grains and the toughness of the grain boundary itself may be reduced, and upon shearing, a strain will concentrate in the grain boundary to develop micro cracks in the shorn edges. Such micro cracks serve as starting points for the development of cracks in the ferrite grain boundary in the subsequent bending operation.

It is believed that TiC precipitating after rolling is coherent with the ferrite matrix (viz. is accompanied by a great amount of strain) and easily causes steel embrittlement. Therefore, it is assumed that suppressing the coherent precipitation of TiC in the ferrite matrix is very important for producing a hot-rolled titanium steel plate having improved formability and toughness at low temperatures.

Encouraged by these observations, the present inventor continued his studies and found that a hot-rolled titanium steel plate whose blank with as-shorn edges has far better formability than the conventional TiC precipitation-hardened steel can be produced by meeting the following requirements:

(i) the steel is hot-rolled with a high reduction in thickness in a low temperature range so that TiC incoherent with the ferrite matrix is uniformly precipitated throughout the structure, i.e. the TiC is precipitated not only in the ferrite grains, but also in the grain boundary by the time the hot rolling is completed, and the precipitation hardening by this type of TiC is used to increase the strength of the steel; and (ii) after rolling, the steel is quenched in order to minimize the amount of coherently precipitated TiC and to increase the amount of Ti in solid solution, which accelerates the formation of a bainitic structure, resulting in a remarkable increase in the strength of the matrix.

Thus, according to the findings of the present inventor, a hot-rolled titanium steel plate in which the amount of titanium incoherently precipitated is restricted to being as large as possible, e.g. to not less than 0.02% by weight and the amount of the titanium coherently precipitated is restricted to being as small as possible, e.g. to not more than 0.015% by weight exhibits improved cold formability as well as toughness including improved resistance to cracking during bending a blank with as-shorn edges. Furthermore, in order to increase the amount of the incoherently precipitated titanium, it is necessary to apply hot rolling at a relatively low temperature with a high reduction in thickness, e.g. in a temperature range of 800°–900° C. with a reduction of 30% or more. On the other hand, in order to reduce the amount of the coherently precipitated titanium and to accelerate the formation of a bainitic structure the presence of which can offset the redution in strength caused by decrease in the amount of coherently precipitated Ti, it is necessary to carry out low temperature coiling after hot rolling, e.g. coiling at a temperature of 500°–200° C.

BRIEF DESCRIPTION OF THE DRAWINGS

FIG. 2(*b*) is a micrograph of a steel plate according to the present invention;

FIG. 4(*b*) is a micrograph showing a nital-etched microphotographic structure of titanium steel coiled at 600° C. after controlled rolling.

SUMMARY OF THE INVENTION

Figure 1:
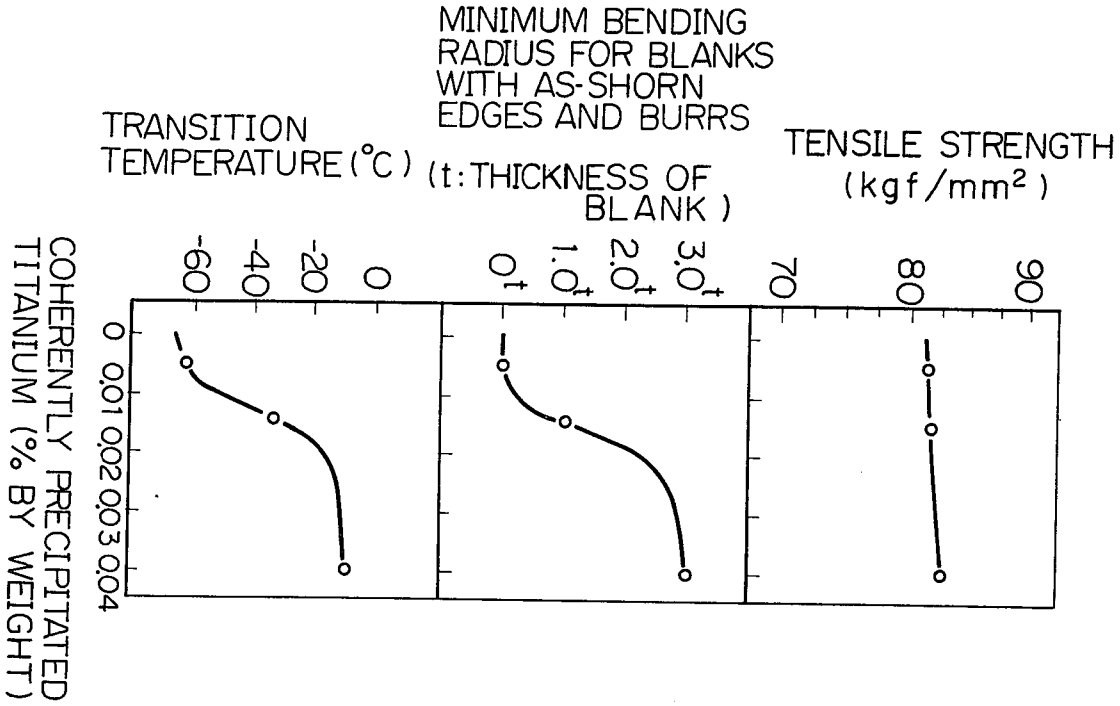
FIG. 1 is a graph showing the relationship between the amount of coherently precipitated Ti and three mechanical properties of hot-rolled titanium steel plates.

A primary object of the present invention is to provide a hot-rolled titanium steel plate having a tensile strength of 70 kg/mm$^2$ or more, as well as improved low temperature toughness and cold formability.

Another object of the present invention is to provide a hot-rolled high tensile titanium steel plate having a tensile strength of 70 kg/mm$^2$ or more, as well as improved low temperature toughness and cold formability including improved resistance to cracking upon bending a blank with as-shorn edges.

Still another object of the present invention is to provide a process for manufacturing a hot-rolled high tensile titanium steel plate having improved low temperature toughness and cold formability including improved resistance to cracking upon bending a blank with as-shorn edges.

Therefore, in essence the present invention resides in:

(1) a hot-rolled high tensile titanium steel plate having improved toughness and cold formability, said steel plate being made of a killed steel which consists essentially of:

| | |
|---|---|
| C: 0.05–0.20 wt %, | Si: not more than 1.2 wt %, |
| Mn: 0.5–2.0 wt %, | Ti: 0.04–0.20 wt %, |
| P: not more than 0.025 wt %, | S: not more than 0.015 wt %, |
| sol. Al: 0.005–0.15 wt %, | O: not more than 0.0080 wt %, |
| N: not more than 0.0080 wt %, | B: 0–0.0030 wt %, |
| Cr: 0–1.0 wt %, | |
| Ca: 0–0.010 wt %, | |

the balance being Fe and incidental impurities, the Ti content comprising not less than 0.02 wt% of incoherently precipitated Ti and not more than 0.015 wt% of coherently precipitated Ti, said killed steel being comprised of 20 to 90% by volume of a bainitic structure and not less than 10% by volume of a ferritic structure;

(2) a process for manufacturing a hot-rolled high tensile titanium steel plate having improved toughness and cold formability, said steel plate being made of a killed steel which consists essentially of:

| | |
|---|---|
| C: 0.05–0.20 wt %, | Si: not more than 1.2 wt %, |
| Mn: 0.5–2.0 wt %, | Ti: 0.04–0.20 wt %, |
| P: not more than 0.025 wt %, | S: not more than 0.015 wt %, |
| sol. Al: 0.005–0.15 wt %, | O: not more than 0.0080 wt %, |
| N: not more than 0.0080 wt %, | B: 0–0.0030 wt %, |
| Cr: 0–1.0 wt %, | |
| Ca: 0–0.010 wt %, | |

the balance being Fe and incidental impurities, said process comprising the steps of applying hot rolling to a killed steel having the above chemical composition with a total reduction in thickness of not less than 30% in a temperature range of 900° C.–800° C., finishing the hot rolling at a temperature not lower than 800° C., rapidly cooling the thus hot-rolled steel plate at a cooling rate of 5° C./sec or higher after finishing the hot rolling, and coiling the thus cooled steel plate in a temperature range of 500° C. to 200° C.; and (3) a process for manufacturing a hot-rolled high tensile titanium steel plate having improved toughness and cold formability, said steel plate being made of a killed steel which consists essentially of:

| | |
|---|---|
| C: 0.05–0.20 wt %, | Si: not more than 1.2 wt %, |
| Mn: 0.5–2.0 wt %, | Ti: 0.04–0.20 wt %, |
| P: not more than 0.025 wt %, | S: not more than 0.015 wt %, |
| sol. Al: 0.005–0.15 wt %, | O: not more than 0.0080 wt %, |
| N: not more than 0.0080 wt %, | B: 0–0.0030 wt %, |
| Cr: 0–1.0 wt %, | |
| Ca: 0–0.010 wt %, | |

the balance being Fe and incidental impurities, said process comprising the steps of applying hot rolling to a killed steel having the above chemical composition with a total reduction in thickness of not less than 30% in a temperature range of 900° C.–800° C., finishing the hot rolling at a temperature not lower than 800° C., cooling the thus hot-rolled steel plate at a cooling rate of air-cooling or higher than the air-cooling after finishing the hot rolling to a temperature range where both ferrite and austenite structures can exist, then air-cooling, slowly cooling, or holding the thus cooled steel plate until 10% or more by volume of a ferrite structure is formed, thereafter rapidly cooling the ferrite-precipitated steel plate at a cooling rate of 5° C./sec or higher, and coiling the thus cooled steel plate in a temperature range of 500° C. to 200° C.

As is apparent from the above, the titanium steel of the present invention may contain not more than 0.0100 wt% of Ca to improve formability. Boron in an amount of not more than 0.0030 wt% may be added to further improve the hardenability of titanium steel. Chromium in an amount of not more than 1.0 wt% may also be added to the steel to further improve the toughness thereof.

The term "incoherently precipitated Ti" means TiC that has been precipitated by the time hot rolling is completed and which leaves no strain around the precipitated TiC. The term "coherently precipitated Ti" means TiC that is finely precipitated in the ferrite matrix after hot rolling, particularly after coiling at elevated temperatures, and which leaves a strain around the precipitated TiC. It is herein to be noted that the TiC referred to in the above as being incoherently precipitated may include, as impurities, an insiginificant amount of unavoidable titanium compounds, such as TiN etc.

DESCRIPTION OF PREFERRED EMBODIMENTS

The reasons for defining the chmical composition, microscopic structure and manufacturing conditions of the steel plate as in the above will hereunder be described.

Carbon (C):

Carbon has the ability to ensure the strength of steels and is essential for achieving a tensile strength of at least 70 kg/mm$^2$. When the carbon content is less than 0.05 wt%, the intended effect is not achieved, and when its content exceeds 0.20 wt%, a high-carbon bainitic structure will result. Such a high-carbon bainitic structure reduces the bending properties, toughness at low temperatures, and even the weldability. Therefore, for the purposes of the present invention, the carbon content is limited to the range of 0.05 to 0.20 wt%.

Silicon (Si):

Silicon has the ability to increase the steel strength due to its solid solution hardening, as well as to deoxidize the steel. For increasing the steel strength, silicon is preferably contained in an amount of at least about 0.05 wt%, but when its content exceeds 1.2 wt%, toughness and weldability are impaired. Therefore, the upper limit of the silicon content is set at 1.2 wt%.

Manganese (Mn):

Manganese is an element that has the ability to increase the toughness of steels. When the manganese content is less than 0.5 wt%, the intended effect is not achieved, and when its content exceeds 2.0 wt%, an A-type inclusion will form easily and the transverse bending formability of the steel is reduced. Therefore, the manganese content is limited to the range of 0.5 to 2.0 wt%.

Titanium (Ti):

Titanium is able to increase the strength of the matrix by forming a bainitic structure the formation of which is accelerated by the presence of Ti in solid solution. The addition of Ti is able to provide a stronger steel by precipitating TiC. Titanium is also capable of improving the ability of the steel to bend in the transverse direction with respect to the rolling direction by converting MnS (A-type inclusion) to TiS (C-type inclusion). However, when the titanium content is less than 0.04 wt%, the steel is not given the desired strength and insufficient control over the shape of inclusions impairs the ability of the steel to bend in the transverse direction. For achieving proper control over the shape of inclusions, titanium is desirably contained in an amount of 0.08 wt% or more. Using more than 0.20 wt% of titanium results in lower weldability.

Phosphorus (P):

Phosphorus has a tendency to embrittle the ferrite grain boundary by segregating in that boundary during slow cooling after coiling. Therefore, to prevent the impairment of the bending ability of a blank with as-shorn edges, the phosphorus content should be held to a minimum, and from an economical viewpoint, the allowable upper limit is defined as 0.025 wt%. A phosphorus content of not more than 0.010 wt% is preferred.

Sulfur (S):

Sulfur is an impurity element that easily binds with Mn in the steel to form an A-type inclusion. The steel contemplated by the present invention contains Ti, but in spite of this, sulfur being present in excess of 0.015 wt% is very likely to bind with Mn to form an A-type inclusion that impairs the bending ability of the steel. Therefore, the upper limit of the sulfur content is set at 0.015 wt%, preferably 0.005 wt%.

Soluble Al:

Soluble aluminum has the ability to ensure the effectiveness of Ti addition. When the content of soluble aluminum is less than 0.005 wt%, the effectiveness of the Ti addition is not fully exhibited, and when its content exceeds 0.15 wt%, the amount of the nonmetallic inclusions is increased and the steel becomes brittle. Therefore, the content of soluble aluminum is limited to the range of 0.005 to 0.15 wt%.

Nitrogen (N):

Nitrogen easily forms TiN in the steel and decreases the amount of Ti present in the form of TiC effective for precipitation hardening or in the form of TiS effective for spheroidization of nonmetallic inclusions. Therefore, the nitrogen content should be held to a minimum, and from an economical viewpoint, the allowable upper limit is set at 0.0080 wt%. A nitrogen content of not more than 0.0050 wt% is preferred.

Oxygen (O):

Oxgen forms $TiO_2$ in the steel and so decreases the amount of Ti present in the form of TiC effective for precipitation hardening or in the form of TiS effective for spheroidization of nonmetallic inclusions. Therefore, the oxygen content should be held to a minimum, and from an economical point of view, the allowable upper limit is set at 0.0080 wt%. An oxygen content of not more than 0.0035 wt% is preferred.

Calcium (Ca):

Calcium is capable of binding with an Al-O compound (B-type inclusion, i.e., inclusions clustered in the rolling direction) to form a C-type inclusion which helps improve the formability of the steel. Since Ti reduces the amount of A-type inclusions and Ca decreases the amount of B-type inclusions, the addition of Ca to a Ti-containing steel is highly preferred for controlling the shape of inclusions. Therefore, when there is a particular need for improving the formability of the steel, Ca is desirably added in an amount of 0.0008 wt% or more. However, when the calcium content exceeds 0.0100 wt%, more inclusions are formed than practically allowed. Consequently, the upper limit of the calcium content is set at 0.0100 wt%.

Boron (B):

Boron has the ability to improve the hardenability of steels and provide them with increased toughness. Adding a trace amount of boron is very effective in the present invention which aims at providing a high tensile steel plate using the mechanism of increasing the steel strength by a bainitic structure. Therefore, if there is a particular need for greater toughness, boron is desirably added in an amount of 0.0001 wt% or more. However, using more than 0.0030 wt% of boron achieves no commensurate increase in the steel toughness. Consequently, the upper limit of the boron content is 0.0030 wt%.

Chromium (Cr):

Like manganese, chromium has the ability to increase the toughness of steels, so if there is a particular need for improving the toughness of the steel of the present invention, chromium is desirably added in an amount of 0.1 wt% or more. However, using more than 1.0 wt% of chromium does not achieve a commensurate improvement, and on the contrary, the weldability of the steel deteriorates. Therefore, the upper limit of the chromium content is set at 1.0 wt%.

Incoherently precipitated Ti:

Hardening due to the precipitation of incoherently precipitated Ti hardly deteriorates the formability of a blank with as-shorn edges, nor does it cause steel embrittlement. When the amount of the incoherently precipitated Ti is less than 0.02 wt%, its hardening effect is small and the intended high steel strength is difficult to attain. Preferably, the amount of the incoherently precipitated Ti is not less than 0.04% by weight.

Coherently precipitated Ti:

Hardening due to the precipitation of the coherently precipitated Ti not only deteriorates the formability of a blank with as-shorn edges, but also causes steel embrittlement. Therefore, for the purposes of the present invention, the amount of coherently precipitated Ti should not be more than 0.015 wt%, preferably not more than 0.010 wt%.

In the working examples of the present invention which will be described later in this specification, the amount of incoherently precipitated Ti was measured in terms of the amount of aqueous HCl(1:1) insoluble Ti of samples prepared by water-quenching steels upon completion of hot rolling at temperatures higher than the $Ar_3$ transformation point. The amount of coherently precipitated Ti was calculated by subtracting the so measured amount of incoherently precipitated Ti from the amount of aqueous HCl (1:1) insoluble Ti in the final steel products.

The amount of incoherently precipitated Ti can be increased by hot-rolling the steel with a high reduction ratio in thickness at a temperature higher than the $Ar_3$ point so as to enhance the precipitation of TiC in the austenitic phase. As already mentioned, this technique not only increases the strength of the steel by TiC precipitation; it also produces less strain around the TiC to thereby prevent the reduction in toughness at low temperatures, a phenomenon peculiar to the conventional Ti-containing hot-rolled steel. The coherent precipitation of Ti occurs in the ferrite phase of a rolled steel when it is coiled at a high temperature (ca. 600° C.), so this phenomenon can be minimized by rapidly cooling the hot-rolled steel to form a bainitic phase, or by avoiding holding the steel at a temperature in the neighborhood of 600° C.

Volume ratio of the bainitic structure:

The bainitic structure is necessary in the present invention for the purpose of increasing steel strength. The present inventor has confirmed that a 10% increase, by volume, of the bainitic structure can increase the tensile strength by as much as 5 to 7 kg/mm$^2$. It is to be noted that the formability of a blank with as-shorn edges is not impaired if there is an increase in the volume of the bainitic structure. In order to achieve the intended tensile strength, the steel of the present invention contains a bainitic structure in a volume ratio of 20% or more, preferably 50% or more. However, when the bainitic structure comprises more than 90% by volume of the steel, the formability of the resulting steel plate becomes highly degraded. The upper limit is set at 90% by volume.

Volume ratio of the ferritic structure:

The presence of a ferritic structure in the titanium steel is necessary for the purpose of improving the formability of the titanium steel of the present invention. A ferritic structure in an amount of less than 10% by volume is not effective for that purpose. Preferably, the ferritic structure is in an amount of 20 to 50% by volume. The "ferritic structure" herein means the ferritic structure which has not been warm-worked, i.e. the ferritic structure formed during cooling after hot rolling.

Hot rolling:

As already mentioned, the coherent precipitation of TiC and the presence of coarse TiN impairs low temperature toughness of titanium steel.

According to the present invention in order to increase the incoherent precipitation of Ti, a controlled rolling is applied to the titanium steel at a temperature of 900° C. or lower with a reduction in thickness of 30% or more, and the rolling is finished at 800° C. or higher temperatures.

When the rolling temperature is higher than 900° C. or the reduction in thickness is smaller than 30%, a sufficient amount of incoherently precipitated Ti is not obtained and fine structure, either, cannot be obtained, so that it is rather difficult to secure low temperature toughness which is satisfactory enough for use as structural materials. On the other hand, when the steel plate is roll finished at a temperature of lower than 800° C., a textured structure forms extensively to provide isotropy in its mechanical properties and the transverse bending properties degrade. Thus, according to the present invention, the steel plate is rolled at a temperature of 900°-800° C. with a reduction in thickness of 30% or more and the rolling is finished at a temperature of 800° C. or higher.

Cooling after hot rolling

According to the present invention, after the above mentioned controlled hot rolling, the hot-rolled steel plate is rapidly cooled to a coiling temperature. The cooling rate is 5° C./sec or higher. Such rapid cooling is desirable to achieve the transformation to bainitic structure by an amount of about 50% by volume, for example. Since a relatively large amount of bainitic structure is formed, such rapidly cooled steel is desirable for use as a high strength steel plate.

In another embodiment of the present invention, the hot rolled steel is cooled by air-cooling or rapid cooling to a temperature range in which a ferritic structure and an austenitic structure can co-exist in order to suppress the formation of coherently precipitated TiC. After that cooling, the resulting steel is further air-cooled, slowly cooled or maintained at that temperature so as to form a ferritic structure in an amount of 10% or more by volume. The ferritic structure which is prepared in this way is very fine resulting in a toughened structure. Preferably, the amount of thus formed ferritic structure is 10-50% by volume. After that, the steel plate which contains 10% by volume or more of ferritic structure is rapidly cooled to a coiling temperature in the range of 500° C. to 200° C. to form a bainitic structure. By the rapid cooling to the coiling temperature without carrying out such a heat treatment as mentioned before, a relatively large amount of bainitic structure is formed. Therefore, when further improved toughness is required, such additional heat treatment is desirable so as to provide the satisfactory toughness. When the rapid cooling to the coiling temperature after the formation of a ferritic structure in an amount of 10% by volume or more is carried out at a cooling rate lower than 5° C./sec, the intended degree of high strength or low temperature toughness cannot be obtained. Thus, according to the present invention, cooling at a rate of 5° C./sec is applied so as to provide a desirable degree of strength and low temperature toughness.

Coiling temperature:

As already mentioned, when the coiling temperature is higher than 500° C., the degradation in bending properties of a blank with as-shorn edges and the transition temperature in a Charpy test is remarkable. On the other hand, when the coiling temperature is lower than 200° C., these properties are also impaired due to the formation of a martensitic structure. Furthermore, a bainitic structure, if it is formed during cooling, is no longer subject to self-tempering during coiling, so that the toughness is not improved. Therefore, according to the present invention, the coiling temperature is defined as 500°-200° C., preferably 400°-200° C.

The present invention is hereunder described by reference to working examples, which are given here for illustrative purposes only and are by no means intended to limit the scope of the invention. Unless otherwise noted, all percentages in the examples are by weight.

EXAMPLE 1

A steel having the chemical composition indicated in Table 1 was prepared, finish rolled at 850° C. with a total reduction in thickness of 50% and coiled at 600° C. to produce a hot-rolled steel plate 6 mm thick. The plate had 0.07 wt% of incoherently precipitated Ti and 0.04 wt% of coherently precipitated Ti.

Another steel having the same chemical composition was finish rolled at 820° C. with a total reduction in thickness of 50%, then rapidly cooled to 400° C. at a rate of 10° C./sec and coiled at 400° C. according to the method of the present invention. A steel plate having a thickness of 6 mm was produced. It had 0.08 wt% of incoherently precipitated Ti and 0.005 wt% of coherently precipitated Ti.

The mechanical properties of the two Ti-containing hot-rolled steel plates are summarized in Table 2.

TABLE 1

| C | Si | Mn | P | S | Ti | Al | O | N |
|---|---|---|---|---|---|---|---|---|
| 0.11 | 0.31 | 1.45 | 0.007 | 0.003 | 0.12 | 0.030 | 0.0023 | 0.0052 |

TABLE 2

| | Comparative Ti-containing plate | Ti-containing plate of the present invention |
|---|---|---|
| Incoherently precipitated Ti (wt %) | 0.07 | 0.08 |
| Coherently precipitated Ti (wt %) | 0.04 | 0.005 |
| Tensile strength ($Kg/mm^2$) | 82 | 83 |
| Minimum bending radius (t: thickness of the blank) | 3.0 t* | 0 t** |
| Transition temp. of the sample (5 mm thick) fractured by Charpy test (°C.) | −10 | −63 |

*The test sample was a blank with as-shorn edges.
**The sample could be closely bent.

Furthermore, steel samples having the composition indicated in Table 1 were hot-rolled and cooled at varying rates to produce steel plates having not more than 0.04 wt% of coherently precipitated Ti. The mechanical properties of the plates were plotted against the amount of coherently precipitated Ti and the results are depicted in FIG. 1 together with the data of Table 2. One can easily see that satisfactory mechanical properties could be obtained by holding the amount of coherently precipitated Ti to a level of not more than 0.015 wt%.

Figure 2A:
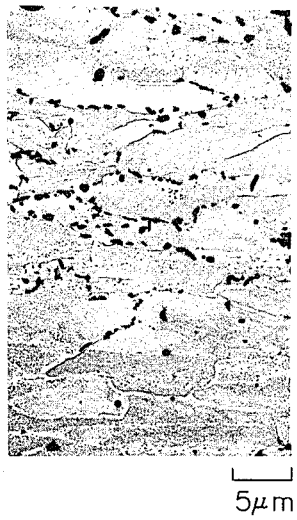
FIG. 2(*a*) is a micrograph showing the structure of a blank replica of a comparative hot-rolled titanium steel plate.
Figure 2B:
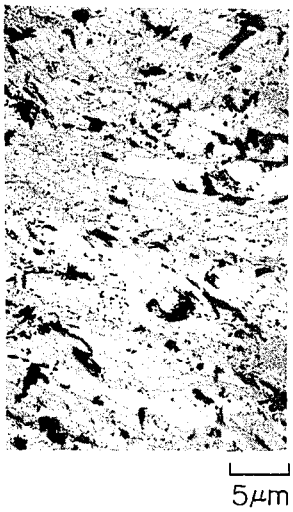

FIG. 2(*a*) is a micrograph showing the structure of a blank replica of the comparative Ti-containing hot-rolled steel plate shown in Table 2, and FIG. 2(*b*) is a micrograph of the steel plate according to the present invention, which is shown in Table 2. As FIG. 2(*a*) shows, the conventional product comprises ferrite and spherical cementite structures. The TiC precipitation within the ferrite grains is marked but the precipitation along the ferrite grain boundary is less marked, showing a white precipitation free zone. On the other hand, as shown in FIG. 2(*b*), the replica of the steel plate of the present invention has a small amount of ferrite structure and is characterized by a TiC precipitation that clearly differs from that observed in the conventional sample. The amount of the ferrite structure was 15% by volume and the bainite structure was 85% by volume.

EXAMPLE 2

Twenty steel samples having the chemical compositions indicated in Table 3 were prepared by the melting-/casting method using a high-frequency furnace. Steel species A to H were within the scope of the present invention, and steel species I to T were comparative samples outside the scope of the present invention. The amounts of the components outside the range defined by the present invention are identified by a single asterisk.

Hot-rolled steel plates 6 mm thick were produced by hot-rolling the respective samples under the conditions indicated in Table 4, wherein the steel species outside the scope of the present invention and the figures of parameters outside the range defined by the present invention are also indicated by a single asterisk.

The mechanical properties of the 21 samples of hot rolled steel plates are also shown in Table 4, from which one can see that sample Nos. 1 to 8 having chemical compositions of steel and microscopic structures as defined in the present invention had high tensile strength and toughness at low temperatures, as well as good bending ability of blanks with as-shorn edges. However, comparative sample Nos. 9 to 21 whose steel chemical composition and/or microscopic structures were outside the scope defined by the present invention had low tensile strength (see sample No. 11, for example), low toughness at low temperatures or poor bending ability of blanks with as-shorn edges.

TABLE 3

| | Chemical Composition (wt %) | | | | | | | | | | |
|---|---|---|---|---|---|---|---|---|---|---|---|
| Steel | C | Si | Mn | P | S | Sol. Al | Ti | N | O | Others | Fe + Impurities |
| Samples of the present invention | | | | | | | | | | | |
| A | 0.10 | 0.31 | 1.54 | 0.008 | 0.004 | 0.023 | 0.12 | 0.0035 | 0.0022 | — | Bal. |
| B | 0.10 | 0.55 | 1.41 | 0.005 | 0.002 | 0.036 | 0.15 | 0.0042 | 0.0062 | — | Bal. |
| C | 0.13 | 0.35 | 1.62 | 0.009 | 0.004 | 0.033 | 0.12 | 0.0062 | 0.0030 | Cr:0.23 | Bal. |
| D | 0.08 | 0.42 | 1.35 | 0.006 | 0.001 | 0.062 | 0.11 | 0.0020 | 0.0025 | Ca:0.0023 | Bal. |
| E | 0.07 | 0.33 | 1.28 | 0.007 | 0.003 | 0.025 | 0.13 | 0.0052 | 0.0032 | B:0.0019 | Bal. |
| F | 0.12 | 0.32 | 1.10 | 0.009 | 0.001 | 0.027 | 0.11 | 0.0037 | 0.0030 | Ca:0.0021 B:0.0012 | Bal. |
| G | 0.09 | 0.55 | 1.70 | 0.008 | 0.001 | 0.052 | 0.12 | 0.0034 | 0.0032 | Ca:0.0022 Cr:0.32 | Bal. |
| H | 0.14 | 0.25 | 1.55 | 0.008 | 0.002 | 0.032 | 0.11 | 0.0053 | 0.0025 | Ca:0.0030 Cr:0.15 B:0.0012 | Bal. |
| Comparative samples | | | | | | | | | | | |
| I | 0.10 | 0.35 | 1.51 | 0.008 | 0.004 | 0.035 | 0.12 | 0.0054 | 0.0100* | — | Bal. |
| J | 0.01* | 0.31 | 1.45 | 0.007 | 0.004 | 0.032 | 0.12 | 0.0042 | 0.0055 | — | Bal. |
| K | 0.25* | 0.05 | 1.32 | 0.008 | 0.001 | 0.033 | 0.12 | 0.0043 | 0.0065 | — | Bal. |
| L | 0.08 | 0.23 | 2.10* | 0.006 | 0.002 | 0.024 | 0.10 | 0.0042 | 0.0042 | — | Bal. |
| M | 0.10 | 0.32 | 1.42 | 0.035* | 0.001 | 0.037 | 0.11 | 0.0042 | 0.0044 | — | Bal. |
| N | 0.08 | 0.36 | 1.32 | 0.008 | 0.025* | 0.033 | 0.12 | 0.0043 | 0.0056 | — | Bal. |
| O | 0.09 | 0.60 | 1.25 | 0.010 | 0.004 | 0.003* | 0.11 | 0.0036 | 0.0100* | — | Bal. |
| P | 0.07 | 0.25 | 1.10 | 0.004 | 0.001 | 0.032 | 0.25* | 0.0035 | 0.0045 | — | Bal. |
| Q | 0.10 | 0.15 | 1.40 | 0.003 | 0.001 | 0.024 | 0.13 | 0.0125* | 0.0052 | — | Bal. |
| R | 0.11 | 0.05 | 0.25* | 0.010 | 0.001 | 0.023 | 0.13 | 0.0040 | 0.0062 | — | Bal. |
| S | 0.09 | 0.23 | 1.25 | 0.008 | 0.001 | 0.200* | 0.14 | 0.0045 | 0.0053 | — | Bal. |
| T | 0.08 | 0.21 | 1.10 | 0.006 | 0.002 | 0.030 | 0.02* | 0.0046 | 0.0045 | — | Bal. |

*Outside the scope of the present invention.

TABLE 4

| | | Conditions for hot-rolling and controlling of microscopic structure | | | | | | | Mechanical Properties | | | | |
|---|---|---|---|---|---|---|---|---|---|---|---|---|---|
| Sample No. | Steel | Heating temp. (°C.) | Total reduction in thickness at 900° C. or less (%) | Finishing Temp. (°C.) | Incoherently precipitated Ti** (wt %) | Coherently precipitated Ti*** (wt %) | Volume ratio of bainite (%) | Volume ratio of ferrite (%) **** | Tensile strength (Kg/mm²) | Total elongation (%) | Transition temp. of the sample (5 mm thick) fructured by Charpy test (°C.) | Minimum bending radius (t) ***** | Remarks |
| Samples of the present invention | | | | | | | | | | | | | |
| 1 | A | 1200 | 60 | 820 | 0.095 | <0.005 | 80 | 20 | 83 | 18 | −68 | 0 | Rapidly |
| 2 | B | " | " | " | 0.130 | 0.005 | 72 | 28 | 82 | 17 | −60 | 1.0 | cooled |
| 3 | C | " | " | " | 0.100 | <0.005 | 87 | 13 | 92 | 16 | −69 | 0 | to |
| 4 | D | " | " | " | 0.085 | 0.010 | 73 | 27 | 75 | 19 | −57 | 0.5 | 400° C. |
| 5 | E | " | " | " | 0.115 | 0.005 | 90 | 10 | 90 | 16 | −60 | 0.5 | after |
| 6 | F | 1250 | 50 | 840 | 0.075 | <0.005 | 89 | 11 | 90 | 16 | −60 | 0 | rolling |
| 7 | G | " | " | " | 0.085 | 0.005 | 90 | 10 | 95 | 15 | −58 | 0 | |
| 8 | H | " | " | " | 0.070 | 0.010 | 85 | 15 | 92 | 16 | −65 | 0 | |
| Comparative samples | | | | | | | | | | | | | |
| 9 | A | 1200 | 60 | 820 | 0.090 | 0.030* | 15* | 85 | 81 | 18 | −10 | 3.5 | Coiled at 600° C. |
| 10 | I* | 1250 | 50 | 840 | 0.105 | <0.005 | 85 | 15 | 75 | 19 | −50 | 1.5 | Rapidly |
| 11 | J* | " | " | " | 0.020 | 0.010 | <10* | >90 | 55 | 26 | −70 | 0 | cooled |
| 12 | K* | " | " | " | 0.100 | <0.005 | 95 | 5 | 115 | 10 | +70 | 4.0 | to |
| 13 | L* | " | " | " | 0.085 | <0.005 | 80 | 20 | 95 | 14 | −45 | 2.5 | 400° C. |

TABLE 4-continued

| Sample No. | Steel | Conditions for hot-rolling and controlling of microscopic structure: Heating temp. (°C.) | Total reduction in thickness at 900° C. or less (%) | Finishing Temp. (°C.) | Incoherently precipitated Ti** (wt %) | Coherently precipitated Ti*** (wt %) | Volume ratio of bainite (%) | Volume ratio of ferrite (%) **** | Mechanical Properties: Tensile strength (Kg/mm²) | Total elongation (%) | Transition temp. of the sample (5 mm thick) fructured by Charpy test (°C.) | Minimum bending radius (t) ***** | Remarks |
|---|---|---|---|---|---|---|---|---|---|---|---|---|---|
| 14 | M* | " | " | " | 0.095 | <0.005 | 85 | 15 | 82 | 16 | −55 | 2.0 | after rolling |
| 15 | N* | " | " | " | 0.095 | <0.005 | 80 | 20 | 84 | 17 | −62 | 2.0 | |
| 16 | O* | " | " | " | 0.095 | <0.005 | 85 | 15 | 75 | 18 | −54 | 2.5 | |
| 17 | P* | " | " | " | — | — | 15* | 85 | 95 | 17 | −30 | 1.5 | |
| 18 | Q* | " | " | " | 0.110 | <0.005 | 85 | 15 | 80 | 18 | −45 | 2.0 | |
| 19 | R* | " | " | " | — | — | — | — | 60 | 24 | −65 | 1.0 | |
| 20 | S* | " | " | " | — | — | — | — | 85 | 16 | −60 | 2.0 | |
| 21 | T* | " | " | " | — | — | — | — | 63 | 24 | −70 | 1.0 | |

*Outside the scope of the present invention.
**Amount of Ti precipitated by the time rolling was completed.
***Amount of Ti precipitated during cooling after hot-rolling.
****Ferrite formed during cooling after hot rolling.
*****Minimum bending radius in the transverse direction for blanks with as-shorn edges and burrs. (t: thickness of the blank)

EXAMPLE 3

A steel having the chemical composition of 0.10%C, 0.30%Si, 1.65%Mn, 0.002%S, 0.17%Ti, 0.025%Al, 0.0035%N and the balance Fe was prepared, hot rolled at 900° C. or lower with a reduction in thickness of 50%, finish rolled at 820° C. to provide a hot-rolled steel plate 6 mm thick, and cooled to a coiling temperature at a cooling rate of 10° C./sec. Bending properties of a blank with as-shorn edges and burrs as well as the transition temperature by the Charpy test deteriorated gradually when the coiling temperature was higher than 400° C. In particular these properties degraded so much that the resulting plate was no longer feasible for practical use when the coiling temperature went up over 500° C. The steel plates coiled at a temperature in the range of 500° to 200° C., preferably 400° to 200° C., exhibited markedly improved formability and low temperature toughness. When the coiling temperature was lower than 200° C., these properties deteriorated.

EXAMPLE 4

Nineteen steel samples having the chemical compositions indicated in Table 5 were prepared by repeating Example 2 above.

Hot-rolled steel plates 6 mm thick were produced by hot-rolling the respective samples under the conditions indicated in Table 6, wherein the steel species outside the scope of the present invention and the figures of parameters outside the range defined by the present invention are also indicated by a single asterisk.

The mechanical properties of the 22 samples of hot-rolled steel plates are also shown in Table 6, from which one can see that sample Nos. 1 to 8 having chemical compositions of steel and microscopic structures as defined in the present invention and being manufactured in accordance with the present invention had high tensile strength and toughness at low temperatures, as well as good bending ability of blanks with as-shorn edges. However, comparative sample Nos. 9 to 22 whose chemical compositions of steel, microscopic structures or hot rolling and coiling conditions were outside the scope defined by the present invention, had low tensile strength or low toughness at low temperatures or poor bending ability of blanks with as-shorn edges. Especially, sample No. 9 which was not subjected to controlled rolling, but to low temperature coiling did not exhibite such microstructure which shows a combined structure of a small amount of fine ferrite and fine bainite, but had coarse bainitic structure resulting in a marked degradation in toughness.

It is herein to be noted that steel species D, F, G and H which contain Ca exhibit a markedly improved bending ability for blanks with as-shorn edges.

TABLE 5

| Steel | Chemical Composition (wt %): C | Si | Mn | P | S | sol. Al | Ti | N | Others | Fe + Impurities |
|---|---|---|---|---|---|---|---|---|---|---|
| Samples of the present invention | | | | | | | | | | |
| A | 0.12 | 0.32 | 1.53 | 0.007 | 0.001 | 0.025 | 0.16 | 0.0032 | — | Bal. |
| B | 0.12 | 0.96 | 1.45 | 0.008 | 0.002 | 0.036 | 0.18 | 0.0029 | — | Bal. |
| C | 0.14 | 0.25 | 1.63 | 0.006 | 0.004 | 0.032 | 0.12 | 0.0018 | Cr:0.52 | Bal. |
| D | 0.09 | 0.43 | 1.28 | 0.004 | 0.002 | 0.037 | 0.13 | 0.0035 | Ca:0.0032 | Bal. |
| E | 0.08 | 0.32 | 1.46 | 0.007 | 0.001 | 0.062 | 0.10 | 0.0019 | B:0.0019 | Bal. |
| F | 0.07 | 0.47 | 1.39 | 0.005 | 0.002 | 0.053 | 0.11 | 0.0023 | Ca:0.0021, B:0.0012 | Bal. |
| G | 0.09 | 0.53 | 1.70 | 0.008 | 0.002 | 0.055 | 0.10 | 0.0016 | Ca:0.0023, Cr:0.31 | Bal. |
| H | 0.13 | 0.43 | 1.52 | 0.008 | 0.003 | 0.062 | 0.13 | 0.0026 | Ca:0.0030, Cr:0.21, B:0.0010 | Bal. |
| Comparative samples | | | | | | | | | | |
| I | 0.02* | 0.30 | 1.52 | 0.008 | 0.002 | 0.035 | 0.12 | 0.0056 | — | Bal. |
| J | 0.25* | 0.05 | 1.30 | 0.007 | 0.001 | 0.051 | 0.14 | 0.0032 | — | Bal. |
| K | 0.12 | 0.32 | 0.35* | 0.006 | 0.002 | 0.031 | 0.12 | 0.0025 | — | Bal. |
| L | 0.08 | 0.23 | 2.20* | 0.008 | 0.003 | 0.034 | 0.10 | 0.0027 | — | Bal. |
| M | 0.12 | 0.32 | 1.48 | 0.030* | 0.001 | 0.021 | 0.12 | 0.0053 | — | Bal. |
| N | 0.08 | 0.36 | 1.54 | 0.009 | 0.020* | 0.031 | 0.14 | 0.0051 | — | Bal. |
| O | 0.09 | 0.07 | 1.43 | 0.007 | 0.001 | 0.003* | 0.10 | 0.0056 | — | Bal. |
| P | 0.10 | 0.41 | 1.52 | 0.008 | 0.002 | 0.190* | 0.10 | 0.0036 | — | Bal. |

TABLE 5-continued

| Steel | Chemical Composition (wt %) C | Si | Mn | P | S | sol. Al | Ti | N | Others | Fe + Impurities |
|---|---|---|---|---|---|---|---|---|---|---|
| Q | 0.08 | 0.24 | 1.38 | 0.006 | 0.003 | 0.037 | 0.02* | 0.0039 | — | Bal. |
| R | 0.08 | 0.20 | 1.32 | 0.008 | 0.002 | 0.033 | 0.25* | 0.0032 | — | Bal. |
| S | 0.08 | 0.32 | 1.35 | 0.007 | 0.002 | 0.046 | 0.10 | 0.0100* | — | Bal. |

TABLE 6

| Sample No. | Steel | Conditions of Hot Rolling and Coiling: Heating Temp. (°C.) | Total reduction in thickness at 900° C. or less (%) | Finishing Temp. (°C.) | Cooling Rate between Finishing and Coiling (°C./sec) | Coiling Temp. (°C.) | Mechanical Properties: Tensile strength (kgf/mm²) | Yielding Point (kgf/mm²) | Total elongation (%) | Transition Temp. of the sample (5 mm thick) fractured by Charpy test (°C.) | Minimum bending radius (t)** |
|---|---|---|---|---|---|---|---|---|---|---|---|
| This Invention | | | | | | | | | | | |
| 1 | A | 1200 | 50 | 860 | 10 | 450 | 84 | 72 | 18 | −56 | 0.5 |
| 2 | B | | 60 | 830 | | | 88 | 74 | 18 | −52 | 0.5 |
| 3 | C | | 50 | 850 | | 400 | 92 | 76 | 16 | −57 | 0.5 |
| 4 | D | | | 840 | | | 81 | 70 | 18 | −55 | 0.0 |
| 5 | E | | 60 | 830 | | 350 | 87 | 72 | 17 | −53 | 0.5 |
| 6 | F | 1280 | 50 | 860 | | 400 | 85 | 73 | 18 | −50 | 0.0 |
| 7 | G | 1200 | | | | 450 | 92 | 79 | 17 | −63 | 0.0 |
| 8 | H | 1250 | 60 | 830 | | | 95 | 82 | 16 | −65 | 0.0 |
| Comparative | | | | | | | | | | | |
| 9 | A | 1200 | 10* | 890 | 12 | 450 | 84 | 72 | 17 | +62 | 1.0 |
| 10 | | | 50 | 770* | 6 | 400 | 83 | 74 | 15 | −50 | 1.5 |
| 11 | | | 60 | 830 | 1* | | 68 | 59 | 21 | −67 | 0.5 |
| 12 | I* | | 50 | | 10 | 450 | 63 | 44 | 18 | −70 | 1.5 |
| 13 | J* | | | | | | 110 | 92 | 12 | +80 | >3.0 |
| 14 | K* | | | | | | 65 | 56 | 24 | −62 | 1.0 |
| 15 | L* | | | | | | 95 | 72 | 16 | −56 | 2.5 |
| 16 | M* | | | | | | 82 | 70 | 17 | −41 | 1.5 |
| 17 | N* | | | | | | 85 | 74 | 18 | −55 | 2.0 |
| 18 | O* | | | | | | 71 | 60 | 20 | −52 | 1.5 |
| 19 | P* | | | | | | 85 | 72 | 16 | −58 | 1.5 |
| 20 | Q* | | | | | | 63 | 49 | 24 | −73 | 1.0 |
| 21 | R* | | | | | | 92 | 81 | 18 | −32 | 1.0 |
| 22 | S* | | | | | | 77 | 62 | 19 | −46 | 1.5 |

| Sample No. | Steel | Incoherently precipitated Ti (wt %) | Coherently precipitated Ti (wt %) | Volume ratio of bainite (%) | Volume ratio of ferrite (%) | Volume ratio of warm-worked ferrite (%) |
|---|---|---|---|---|---|---|
| This Invention | | | | | | |
| 1 | A | 0.11 | <0.005 | 76 | 24 | 0 |
| 2 | B | 0.12 | 0.006 | 76 | 24 | 0 |
| 3 | C | 0.08 | 0.005 | 85 | 15 | 0 |
| 4 | D | 0.10 | 0.007 | 79 | 21 | 0 |
| 5 | E | 0.06 | <0.005 | 84 | 16 | 0 |
| 6 | F | 0.08 | <0.005 | 88 | 12 | 0 |
| 7 | G | 0.07 | <0.005 | 87 | 13 | 0 |
| 8 | H | 0.09 | <0.005 | 88 | 12 | 0 |
| Comparative | | | | | | |
| 9 | A | 0.03 | <0.005 | 96 | 4 | 0 |
| 10 | | 0.12 | <0.005 | 60 | 5 | 35 |
| 11 | | 0.12 | 0.020 | 2 | 98 | 0 |
| 12 | I* | 0.06 | <0.005 | 8 | 92 | 0 |
| 13 | J* | 0.10 | 0.010 | 97 | 3 | 0 |
| 14 | K* | 0.09 | 0.006 | 38 | 62 | 0 |
| 15 | L* | 0.08 | <0.005 | 99 | 1 | 0 |
| 16 | M* | 0.09 | <0.005 | 86 | 24 | 0 |
| 17 | N* | 0.11 | <0.005 | 80 | 20 | 0 |
| 18 | O* | 0.06 | <0.005 | 85 | 15 | 0 |
| 19 | P* | 0.06 | <0.005 | 76 | 24 | 0 |
| 20 | Q* | 0.015 | <0.005 | 70 | 30 | 0 |
| 21 | R* | 0.18 | <0.005 | 82 | 18 | 0 |
| 22 | S* | 0.08 | <0.005 | 77 | 23 | 0 |

*Outside the scope of the present invention
**Minimum bending radius in the transverse direction for blanks with as-shorn edges and burrs (t: thickness of the blank)

EXAMPLE 5

Figure 3:
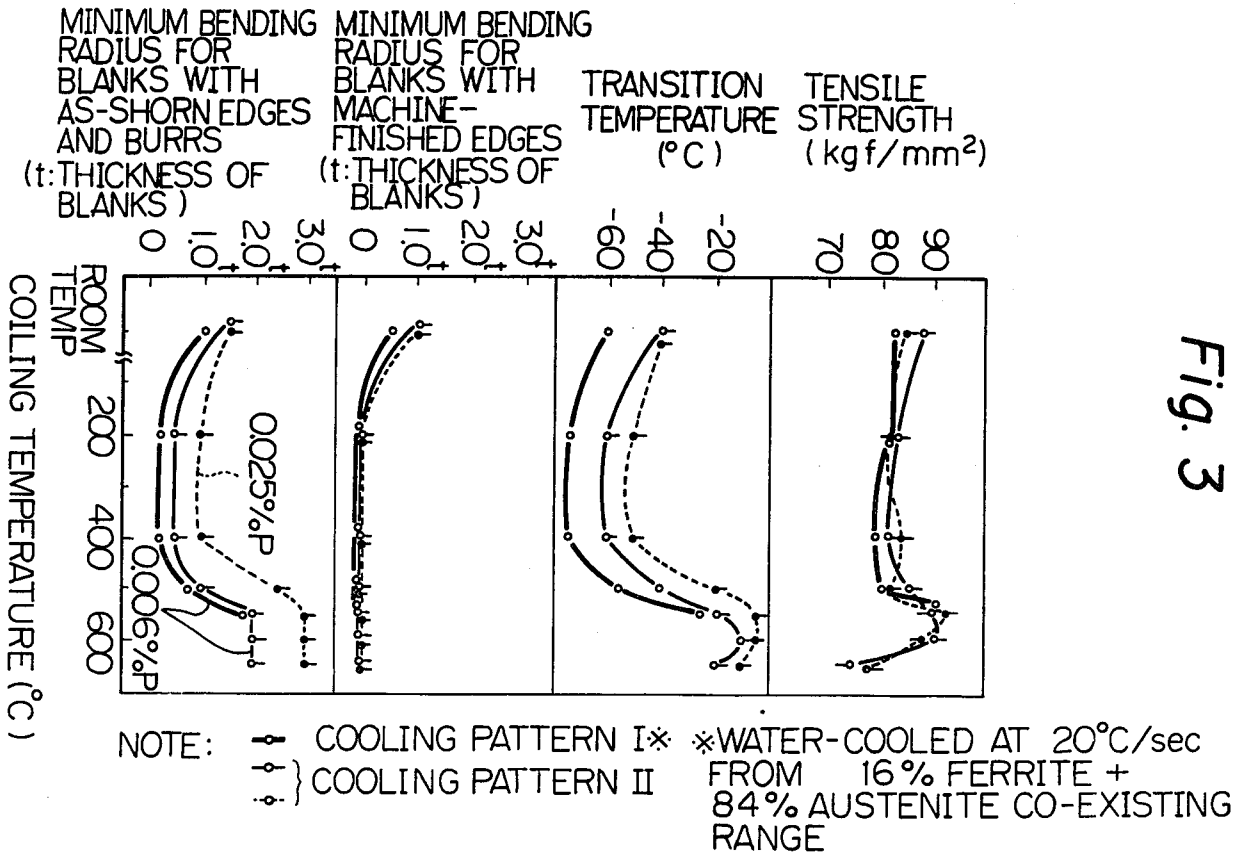
FIG. 3 is a graph showing the effect of coiling temperatures on mechanical properties of titanium steel.

In this example, Example 3 was repeated except that after finishing the hot rolling, the hot rolled steel plates were cooled to a coiling temperature in accordance with either one of the following two cooling patterns. That is, one is that until it reaches 650° C., the hot rolled plate is cooled with water at a cooling rate of 20° C./sec, then air-cooled for 10 seconds and further cooled with water at a cooling rate of 20° C./sec to a coiling temperature (Cooling Pattern I), and the other is that the hot rolled plate is cooled with water at a cooling rate of 10° C./sec to a coiling temperature (Cooling Pattern II). The mechanical properties of the thus obtained hot-rolled steel plates are summarized with respect to the coiling temperature in FIG. 3. As is apparent from the groups shown in FIG. 3, bending properties of a blank with as-shorn edges as well as the transition temperature thereof by the Charpy test deteriorate gradually when the coiling temperature is higher than 400° C. In particular these properties degrade so much that the resulting plate is no longer feasible for practical use when the coiling temperature goes up over 500° C. The steel plates coiled at a temperature in the range of 500° to 200° C., preferably 400° to 200° C., exhibit markedly improved formability and low temperature toughness. When the coiling temperature is lower than 200° C., these properties deteriorate, too. In addition, when the Cooling Pattern I is applied, the resulting steel plate exhibits further improved properties in comparison with the case of Cooling Pattern II. It is herein to be noted that the P content has an influence on these properties and a P content of not more than 0.025% is preferable. In the figures the solid dots show the case of 0.025%P and the open dots show the case of 0.006%P.

Figure 4:
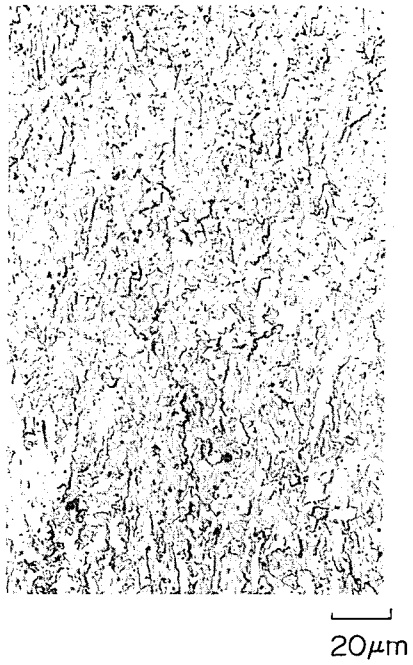
FIG. 4(*a*) is a micrograph showing a nital-etched microphotographic structure of titanium steel which was, after controlled rolling, cooled according to Cooling Pattern I and coiled at 400° C.
Figure 4:
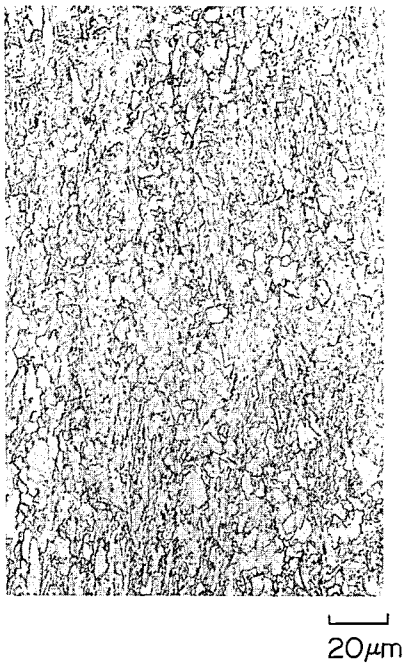

FIG. 4(*b*) is a micrograph showing a nital-etched microstructure of a conventional hot-rolled Ti-steel plate which was coiled at 600° C., and FIG. 4(*a*) is a micrograph of the steel plate which was cooled after hot rolling by the Cooling Pattern I and coiled at 400° C. according to the present invention. As FIG. 4(*b*) shows, the steel plate which was coiled at 600° C. without effecting the controlled cooling before coiling is accompanied by uneven corrosion of the ferrite grain boundaries. However, the structure shown in FIG. 4(*a*) is free from the corrosion exhibited in FIG. 4(*b*).

EXAMPLE 6

Nineteen steel samples having the chemical compositions indicated in Table 5 were prepared by repeating Example 4 above.

Hot-rolled steel plates 6 mm thick were produced by hot-rolling the respective samples under the conditions indicated in Table 7, wherein the steel species outside the scope of the present invention and the figures of parameters outside the range defined by the present invention are also indicated by a single asterisk.

The mechanical properties as well as metallurgical structures of the 22 samples of hot-rolled steel plates are also shown in Tables 7 and 8 of which Table 8 shows volume ratios of bainitic and ferritic structures thereof. From the experimental data shown therein one can seen that sample Nos. 1 to 9 having chemical compositions of steel and microscopic structures as defined in the present invention and being manufactured in accordance with the present invention had high tensile strength and toughness at low temperatures, as well as good bending ability of blanks with as-shorn edges. However, comparative sample Nos. 10 to 22 whose chemical steel compositions, microscopic structures or hot rolling and coiling conditions were outside the scope defined by the present invention had low tensile strength, low toughness at low temperatures or poor bending ability of blanks with as-shorn edges. In particular, sample No. 10 which was not subjected to controlled rolling, but to low temperature coiling did not exhibit such microstructure as shown in FIG. 4(*a*) which shows a combined structure of 10% by volume or more of fine ferrite and a substantial amount of fine bainite, but had a coarse bainitic structure resulting in a marked degradation in toughness.

It is herein to be noted that steel species D, F, G and H which contain Ca exhibit a markedly improved bending ability for blanks with as-shorn edges.

TABLE 7

| | | Conditions of Hot Rolling and Coiling | | | | | Volume Ratio of Ferrite just before final Water-cooling | Mechanical Properties | | | | |
|---|---|---|---|---|---|---|---|---|---|---|---|---|
| Sample No. | Steel | Heating Temp. (°C.) | Total Reduction in thickness at 900° C. or less (%) | Finishing Temp. (°C.) | Cooling Rate after hot rolling until Coiling | Coiling Temp. (°C.) | (%) | Tensile Strength (kgf/mm²) | Yielding Point (kgf/mm²) | Total elongation (%) | Transition Temp. of the sample (5 mm thick) fractured by Charpy test (°C.) | Minimum bending radius (t)** |
| This invention | | | | | | | | | | | | |
| 1 | A | 1200 | 70 | 820 | Air-cooling for 25 secs., then water-cooling at 40° C./sec | 460 | 12 | 84 | 72 | 17 | −65 | 0.25 |
| 2 | | | | 830 | Water-cooling | | 18 | 83 | 70 | 18 | −75 | 0.25 |
| 3 | B | | 60 | 840 | for 5 secs. at 20° C./sec, | 400 | 25 | 87 | 73 | 19 | −62 | 0.25 |
| 4 | C | | 70 | 830 | ↓ | | 15 | 90 | 77 | 16 | −70 | 0.25 |
| 5 | D | | | | Air-cooling | 350 | 21 | 82 | 70 | 18 | −75 | 0.0 |
| 6 | E | | 60 | 850 | for 12 secs., | 400 | 15 | 85 | 71 | 17 | −63 | 0.25 |
| 7 | F | 1280 | 50 | 860 | ↓ | | 15 | 83 | 72 | 18 | −67 | 0.0 |
| 8 | G | 1200 | | | Water-cooling | 450 | 14 | 90 | 78 | 17 | −76 | 0.0 |
| 9 | H | 1250 | 60 | 840 | at 20° C./sec | | 12 | 93 | 80 | 16 | −77 | 0.0 |
| Comparative | | | | | | | | | | | | |
| 10 | A | 1200 | 10* | 890 | Water-cooling | 400 | <10 | 84 | 72 | 18 | +45 | 1.0 |
| 11 | | | 70 | 770* | for 5 secs. | | 35 | 83 | 74 | 15 | −80 | 1.5 |
| 12 | I* | | | 830 | at 20° C./sec, | 450 | 88 | 63 | 42 | 19 | −75 | 1.0 |
| 13 | J* | | | | | | <10 | 112 | 91 | 11 | +80 | 3.0 |
| 14 | K* | | | | ↓ | | 65 | 65 | 55 | 25 | −65 | 1.0 |
| 15 | L* | | | | | | <10 | 95 | 74 | 17 | −60 | 2.5 |
| 16 | M* | | | | Air-cooling | | 24 | 83 | 72 | 17 | −55 | 1.5 |
| 17 | N* | | | | for 12 secs., | | 20 | 85 | 74 | 18 | −60 | 1.5 |

TABLE 7-continued

| Sample No. | Steel | Conditions of Hot Rolling and Coiling: Heating Temp. (°C.) | Total Reduction in thickness at 900° C. or less (%) | Finishing Temp. (°C.) | Cooling Rate after hot rolling until Coiling | Coiling Temp. (°C.) | Volume Ratio of Ferrite just before final Water-cooling (%) | Mechanical Properties: Tensile Strength (kgf/mm²) | Yielding Point (kgf/mm²) | Total elongation (%) | Transition Temp. of the sample (5 mm thick) fractured by Charpy test (°C.) | Minimum bending radius (t)** |
|---|---|---|---|---|---|---|---|---|---|---|---|---|
| 18 | O* | | | | ↓ | | 19 | 70 | 58 | 21 | −57 | 1.0 |
| 19 | P* | | | | Water-cooling | | 29 | 85 | 72 | 16 | −64 | 1.0 |
| 20 | Q* | | | | at 20° C./sec | | 35 | 62 | 47 | 25 | −79 | 1.0 |
| 21 | R* | | | | | | 20 | 91 | 80 | 18 | −45 | 1.0 |
| 22 | S* | | | | | | 23 | 77 | 60 | 19 | −50 | 1.5 |

NOTE
*Outside the scope of the present invention
**Minimum bending radius in the transverse direction for blanks with as-shorn edges and burrs (t: thickness of the blank)

TABLE 8

| Sample No. | Steel | Incoherently precipitated Ti (wt %) | Coherently precipitated Ti (wt %) | Volume ratio of bainite (%) | Volume ratio of ferrite (%) | Volume ratio of warm-worked ferrite (%) |
|---|---|---|---|---|---|---|
| This invention | | | | | | |
| 1 | A | 0.11 | 0.012 | 80 | 20 | 0 |
| 2 | | 0.11 | 0.008 | 74 | 26 | 0 |
| 3 | B | 0.13 | 0.010 | 72 | 28 | 0 |
| 4 | C | 0.07 | 0.005 | 81 | 19 | 0 |
| 5 | D | 0.09 | 0.008 | 74 | 26 | 0 |
| 6 | E | 0.07 | 0.005 | 84 | 16 | 0 |
| 7 | F | 0.08 | <0.005 | 83 | 17 | 0 |
| 8 | G | 0.07 | 0.009 | 85 | 15 | 0 |
| 9 | H | 0.11 | 0.008 | 87 | 13 | 0 |
| Comparative | | | | | | |
| 10 | A | 0.03 | <0.005 | 95 | 5 | 0 |
| 11 | | 0.14 | <0.005 | 55 | 5 | 40 |
| 12 | I* | 0.06 | <0.005 | 10 | 90 | 0 |
| 13 | J* | 0.10 | 0.012 | 96 | 4 | 0 |
| 14 | K* | 0.09 | 0.013 | 31 | 69 | 0 |
| 15 | L* | 0.08 | <0.005 | 97 | 3 | 0 |
| 16 | M* | 0.10 | 0.007 | 74 | 26 | 0 |
| 17 | N* | 0.11 | 0.010 | 77 | 23 | 0 |
| 18 | O* | 0.08 | 0.006 | 80 | 20 | 0 |
| 19 | P* | 0.07 | 0.015 | 69 | 31 | 0 |
| 20 | Q* | 0.015 | <0.005 | 63 | 37 | 0 |
| 21 | R* | 0.21 | 0.020 | 77 | 23 | 0 |
| 22 | S* | 0.07 | 0.010 | 74 | 26 | 0 |

*Outside the scope of the present invention
The sample Nos. and the steel indications are the same as in Table 7.

What is claimed is:

1. A hot-rolled high tensile titanium steel plate having improved toughness and cold formability, said steel plate being made of a killed steel which consists essentially of:

| | |
|---|---|
| C: 0.05–0.20 wt %, | Si: not more than 1.2 wt %, |
| Mn: 0.5–2.0 wt %, | Ti: 0.04–0.20 wt %, |
| P: not more than 0.025 wt %, | S: not more than 0.015 wt %, |
| sol. Al: 0.005–0.15 wt %, | O: not more than 0.0080 wt %, |
| N: not more than 0.0080 wt %, | B: 0–0.0030 wt %, |
| Cr: 0–1.0 wt %, | |
| Ca: 0–0.010 wt %, | |

the balance being Fe and incidental impurities, the Ti content comprising not less than 0.02 wt% of incoherently precipitated Ti and not more than 0.015 wt% of coherently precipitated Ti, and said killed steel containing 20 to 90% by volume of a bainitic structure and not less than 10% by volume of a ferritic structure.

2. A hot-rolled high tensile titanium steel plate as defined in claim 1, in which the amount of incoherently precipitated Ti is not less than 0.04 wt%.

3. A hot-rolled high tensile titanium steel plate as defined in claim 1, in which the amount of coherently precipitated Ti is not more than 0.010 wt%.

4. A hot-rolled high tensile titanium steel plate as defined in claim 1, in which the bainitic structure is in an amount of 50–90% by volume and the ferritic structure is 20–50% by volume.

5. A hot-rolled high tensile titanium steel plate having improved toughness and cold formability, said steel plate being made of a killed steel which consists essentially of:

| |
|---|
| C: 0.05–0.20 wt %, |
| Mn: 0.5–2.0 wt %, |
| P: not more than 0.010 wt %, |
| sol. Al: 0.005–0.15 wt %, |
| N: not more than 0.0050 wt %, |
| Cr: 0–1.0 wt %, |
| Ca: 0–0.010 wt %, |
| Si: not more than 1.2 wt %, |
| Ti: 0.08–0.20 wt %, |
| S: not more than 0.005 wt %, |
| O: not more than 0.0035 wt %, |
| B: 0–0.0030 wt %, |

the balance being Fe and incidental impurities, the Ti content comprising not less than 0.02 wt% of incoherently precipitated Ti and not more than 0.015 wt% of coherently precipitated Ti, and said killed steel containing 20 to 90% by volume of a bainitic structure and not less than 10% by volume of a ferritic structure.

6. A hot-rolled high tensile titanium steel plate as defined in claim 5, in which the amount of incoherently precipitated Ti is not less than 0.04 wt%.

7. A hot-rolled high tensile titanium steel plate as defined in claim 5, in which the amount of coherently precipitated Ti is not more than 0.010 wt%.

8. A hot-rolled high tensile titanium steel plate as defined in claim 5, in which the baintic structure is in an amount of 50–90% by volume and the ferritic structure is 20–50% by volume.

9. A hot rolled high tensile titanium steel plate as defined in claim 1, in which the steel plate has a tensile strength of 70 kg/mm² or more and is 4.5 mm or larger thick.

10. A hot rolled high tensile titanium steel plate as defined in claim 5, in which the steel plate has a tensile strength of 70 kg/mm$^2$ or more and is 4.5 mm or larger thick.

11. A process for manufacturing hot-rolled high tensile titanium steel plate having improved toughness and cold formability, said steel plate being made of a killed steel which consists essentially of:

| | |
|---|---|
| C: 0.05–0.20 wt %, | Si: not more than 1.2 wt %, |
| Mn: 0.5–2.0 wt %, | Ti: 0.04–0.20 wt %, |
| P: not more than 0.025 wt %, | S: not more than 0.015 wt %, |
| sol. Al: 0.005–0.15 wt %, | O: not more than 0.0080 wt %, |
| N: not more than 0.0080 wt %, | B: 0–0.0030 wt %, |
| Cr: 0–1.0 wt %, | |
| Ca: 0–0.010 wt %, | |

the balance being Fe and incidental impurities, said process comprising the steps of:

applying hot rolling to a killed steel having the chemical composition above with a total reduction in thickness of not less than 30% in a temperature range of 900° C.–800° C.;

finishing the hot rolling at a temperature not lower than 800° C.; rapidly cooling the thus hot-rolled steel plate at a cooling rate of 5° C./sec or higher after finishing the hot rolling; and coiling the thus cooled steel plate in a temperature range of 500° C. to 200° C.

12. A process for manufacturing hot-rolled high tensile titanium steel plate as defined in claim 11, in which the hot rolled steel plate after cooling is coiled at a temperature range of 400°–200° C.

13. A hot-rolled high tensile titanium steel plate manufactured in accordance with the process defined in claim 11.

14. A hot rolled high tensile titanium steel plate as defined in claim 12.

15. A hot rolled high tensile titanium steel plate having a tensile strength of 70 kg/mm$^2$ or more and being 4.5 mm or larger thick produced by the process of claim 11.

16. A process for manufacturing hot-rolled high tensile titanium steel plate having improved toughness and cold formability, said steel plate being made of a killed steel which consists essentially of:

| | |
|---|---|
| C: 0.05–0.20 wt %, | Si: not more than 1.2 wt %, |
| Mn: 0.5–2.0 wt %, | Ti: 0.04–0.20 wt %, |
| P: not more than 0.025 wt %, | S: not more than 0.015 wt %, |
| sol. Al: 0.005–0.15 wt %, | O: not more than 0.0080 wt %, |
| N: not more than 0.0080 wt %, | B: 0–0.0030 wt %, |
| Cr: 0–1.0 wt %, | |
| Ca: 0–0.010 wt %, | |

the balance being Fe and incidental impurities, said process comprising the steps of:

applying hot rolling to a killed steel having the chemical composition above with a total reduction in thickness of not less than 30% in a temperature range of 900° C.–800° C.;

finishing the hot rolling at a temperature not lower than 800° C.;

cooling the thus hot-rolled steel plate at a cooling rate of air-cooling or higher than the air-cooling after finishing the hot rolling to a temperature range where ferrite and austenite coexist;

then air-cooling, slowly cooling, or holding the thus cooled steel plate until 10% or more by volume of ferritic structure is formed;

thereafter rapidly cooling the ferrite-precipitated steel plate at a cooling rate of 5° C./sec or higher; and coiling the thus cooled steel plate in a temperature range of 500° C. to 200° C.

17. A process for manufacturing hot-rolled high tensile titanium steel plate as defined in claim 16, in which the hot rolled steel plate after cooling is coiled at a temperature range of 400°–200° C.

18. A hot-rolled high tensile titanium steel plate manufactured in accordance with the process defined in claim 16.

19. A hot rolled high tensile titanium steel plate as defined in claim 17.

20. A hot rolled high tensile titanium steel plate having a tensile strength of 70 kg/mm$^2$ or more and 4.5 mm or larger thick produced by the process of claim 16.

* * * * *